US007359664B2

(12) United States Patent
Yamada

(10) Patent No.: US 7,359,664 B2
(45) Date of Patent: Apr. 15, 2008

(54) FIXING DEVICE FOR AN IMAGE FORMING APPARATUS INCLUDING SUPPORTING MEMBERS FOR FIXING BELTS OF THE FIXING DEVICE

(75) Inventor: Masamichi Yamada, Yokohama (JP)

(73) Assignee: Ricoh Co., Ltd., Tokyo (JP)

( * ) Notice: Subject to any disclaimer, the term of this patent is extended or adjusted under 35 U.S.C. 154(b) by 300 days.

(21) Appl. No.: 11/216,113

(22) Filed: Sep. 1, 2005

(65) Prior Publication Data

US 2006/0045590 A1 Mar. 2, 2006

(30) Foreign Application Priority Data

Sep. 1, 2004 (JP) ..... 2004-254649

(51) Int. Cl.
*G03G 15/20* (2006.01)

(52) U.S. Cl. ..... 399/329

(58) Field of Classification Search ..... 399/69, 399/320, 327, 328, 329; 219/216
See application file for complete search history.

(56) References Cited

U.S. PATENT DOCUMENTS

| | | | | |
|---|---|---|---|---|
| 3,716,018 | A * | 2/1973 | Ohta et al. | 118/101 |
| 4,242,566 | A * | 12/1980 | Scribner | 219/216 |
| 5,319,429 | A * | 6/1994 | Fukuchi et al. | 399/321 |
| 5,758,245 | A * | 5/1998 | Matsuura et al. | 399/329 |
| 5,927,189 | A * | 7/1999 | Jones et al. | 101/23 |
| 6,088,558 | A | 7/2000 | Yamada et al. | |
| 6,091,926 | A | 7/2000 | Yamada | |
| 6,092,891 | A * | 7/2000 | Okubo et al. | 347/104 |
| 6,130,408 | A * | 10/2000 | Fukuda et al. | 219/216 |
| 6,351,619 | B1 | 2/2002 | Yamada | |
| 6,370,352 | B1 * | 4/2002 | Tomita | 399/328 |
| 6,553,204 | B1 | 4/2003 | Yamada | |
| 6,577,840 | B2 | 6/2003 | Hachisuka et al. | |
| 6,721,532 | B2 * | 4/2004 | Kosugi et al. | 399/341 |
| 6,810,228 | B2 * | 10/2004 | Kiuchi et al. | 399/307 |
| 6,865,363 | B2 | 3/2005 | Hachisuka et al. | |
| 6,925,280 | B2 | 8/2005 | Yamada | |
| 2003/0231893 | A1 * | 12/2003 | Yoshikawa | 399/69 |

FOREIGN PATENT DOCUMENTS

| | | |
|---|---|---|
| JP | 05-072926 | 3/1993 |
| JP | 10-307501 | 11/1998 |
| JP | 2000-081804 | 3/2000 |
| JP | 2002-072724 | 3/2002 |
| JP | 2002-351143 | 12/2002 |
| JP | 2004-029360 | 1/2004 |
| JP | 2004198469 A * | 7/2004 |

* cited by examiner

*Primary Examiner*—Robert Beatty
(74) *Attorney, Agent, or Firm*—Oblon, Spivak, McClelland, Maier & Neustadt, P.C.

(57) ABSTRACT

A fixing device for fixing a toner image on a recording medium includes first and second belts rotatably disposed opposite to each other such that the recording medium having the toner image thereon moves therebetween, a fixing roller disposed in contact with an inner surface of the first belt, a pressure roller disposed in contact with an inner surface of the second belt, the fixing and pressure rollers forming a first nip part therebetween, a first supporting member disposed downstream of the fixing roller and held in contact with the inner surface of the first belt, and a second supporting member disposed downstream of the pressure roller and held in contact with the inner surface of the second belt. A second nip part is formed downstream of the first nip portion and upstream of the first and second supporting members facing each other via the first and second belts.

23 Claims, 3 Drawing Sheets

FIXING DEVICE FOR AN IMAGE FORMING APPARATUS INCLUDING SUPPORTING MEMBERS FOR FIXING BELTS OF THE FIXING DEVICE

CROSS REFERENCE TO RELATED APPLICATIONS

The present application claims priority to Japanese patent application no. 2004-254649, filed in the Japan Patent Office on Sep. 1, 2004, the disclosure of which is incorporated by reference herein in its entirety.

BACKGROUND OF THE INVENTION

1. Field of the Invention

The present invention relates to a fixing device and an image forming apparatus, and more particularly relates to a fixing device and an image forming apparatus including the fixing device for fixing an image on a recording medium.

2. Discussion of the Background

In a typical copying or printing process performed by an image forming apparatus, such as a copier, printer, facsimile machine, printing press and the like, an electrostatic latent image formed on an image bearing member or a photoconductive member is developed by conveying one or more developer materials such as toner particles to be transferred to the electrostatic latent image and is visualized as a toner image. The toner image is then transferred from the image bearing member onto a recording medium such as a recording sheet, and is conveyed to a fixing device. In the fixing device, the toner particles forming the toner image on the recording medium are subjected to a combination of application of heat and pressure to permanently affix the toner image to the recording sheet.

The fixing device may employ a heat roller fixing method in which a recording medium having an unfixed image thereon is conveyed while being sandwiched between a pair or rollers including a heat roller that has a heat source therein and a pressure roller capable of forming a fixing nip portion by facing the heat roller. The heat roller fixing method has used heat rollers including a material having a relatively large heat capacity. Such heat rollers may require a long period of time to raise the temperature thereof to a predetermined temperature, which results in a long standby period.

One way to achieve a lesser period of time to be raised to the predetermined temperature and a longer fixing nip portion is to use a deformable belt as a heat member spanned around a plurality of rollers and contacting toner. The deformable belt may have a thickness smaller than that of other heat members such as a roller so as to reduce a heat capacity thereof and thus reduce the period of rise time to the predetermined temperature. Thus, the flexibility of the belt allows a heat transfer area to be larger and longer.

Another way is to use a pair of endless belts which are spanned around respective rollers and face to each other while a recording medium having unfixed toner images on front and rear side surfaces thereof is sandwiched between the pair of endless belts. When fixing the toner images, respective fixing and pressure rollers internally contacting the pair of endless belts press each other so that the toner images can be permanently fixed to the recording medium.

Some toner particles heated and pressed may attach to the heat member, which may cause a hot offset. To prevent the hot offset, the heat member heretofore may have a surface of a layer including a fluorocarbon resin material or a surface overcoated with a releasing material such as silicone oil. Further, respective cooling mechanisms may be disposed opposite a fixing belt after a recording medium having toner images on front and rear side surfaces passes a fixing nip portion formed between a fixing roller and a pressure roller.

For recent demands for higher image resolution, the toner for visualizing the electrostatic latent image is studied to have further sphericity and a smaller particle diameter to form high definition images. As the toner prepared by pulverizing methods has a limit with respect to these properties, polymerized toners prepared by suspension polymerizing methods, emulsification polymerizing methods and dispersion polymerizing methods capable of conglobating the toner and making the toner have a small particle diameter are being used. Further, some toner may include a wax component to prevent the hot offset by itself.

To elongate the fixing nip portion (or length) formed between a pair of pressure rollers sandwiching a fixing belt, one of a pair of pressing roller presses the fixing belt toward the other of the pair of pressing rollers. The above-described application of pressure may form a depression or impression on the surface of the fixing belt along the periphery of other roller. Thus, a longer length for the fixing nip portion can be obtained.

The deformation of the fixing belt along the periphery of the other roller, however, may lose planarity of the fixing belt. Even though the deformation of the fixing belt may not significantly affect a recording medium having a relatively long length, it may produce a wrinkled surface or a deviated flap of a recording medium having a short length such as an envelope to lose the planarity at the fixing nip portion.

After passing the fixing nip portion, the recording medium may be removed from the fixing belt by a self stripping action due to a curvature of a roller. When an outer diameter of the roller is large, a stripping member such as a stripping finger disposed in the vicinity of the roller may be used to separate the recording medium from the fixing belt to compensate for a deficiency of curvature of the roller. When the stripping finger, however, is disposed to support the stripping action, the leading edge of the stripping finger may be held in contact with the periphery of the roller to pick up the recording medium. In this case, the leading edge of the stripping finger may rub or scrape the toner image formed on the recording medium and/or may wear or abrade the surface of the fixing belt, which may produce scratches on the recording medium and/or affect durability of the fixing belt due to abrasion. Toner particles may also be damaged when the fixing belt itself having scratches thereon rubs or scrapes the toner particles in the process of fusing or melting.

To reduce frictional resistance at the contact of the fixing belt and/or the stripping finger with the toner images and/or the toner particles, a releasing agent originally used for a prevention of the hot offset may be overcoated on the surface of the fixing belt. Some toner, however, may recently include a wax component to omit coating a lubricant onto belts and/or rollers to protect the belts and/or rollers. This makes it difficult to achieve an elimination of the above-described scratches.

When a belt-type fixing member is used, a period of rise time of the temperature can be reduced because the belt itself may need a lower heat capacity. The belt, however, is wound around supporting rollers including a fixing roller and a pressure roller. The fixing roller and the pressure roller are provided to form a fixing nip portion but are not provided with a heat roller. This structure may lose heat dissipated from the fixing belt to the fixing roller when the fixing device is not in operation. Further, the period of rise time to the predetermined temperature may be longer and/or an equilibrium state of the temperature may be unstable.

SUMMARY OF THE INVENTION

The present invention has been made in view of the above-mentioned circumstances.

An object of the present invention is to provide a novel fixing device having a structure in which a period of time to be raised to a predetermined temperature may be reduced regardless of types of recording media, and damage to a recording medium, belts and rollers may be prevented so as to prevent deterioration in image quality of a fixed toner image.

Another object of the present invention is to provide a novel image forming apparatus including the above-described novel fixing device.

In one embodiment, a novel fixing device fixing a toner image on a recording medium includes first and second belts, a fixing roller, a pressure roller, and first and second supporting members. The first and second belts are rotatably disposed opposite to each other such that the recording medium having the toner image thereon moves therebetween. The fixing roller is disposed in contact with an inner surface of the first belt. The pressure roller is disposed in contact with an inner surface of the second belt and facing the fixing roller via the first and second belts. The fixing roller and the pressure roller form a first nip part. The first supporting member is disposed downstream of the fixing roller and is held in contact with the inner surface of the first belt. The second supporting member is disposed downstream of the pressure roller, is held in contact with the inner surface of the second belt, and faces the first supporting member via the first and second belts. A second nip part is formed downstream of the first nip portion and upstream of a portion between the first and second supporting members facing each other via the first and second belts.

Further, in one embodiment, a novel image forming apparatus includes an image forming unit, an image transferring unit, and a fixing device. The image forming unit is configured to form a toner image. The image transferring unit is configured to transfer the toner image from the image forming unit to a recording medium. The fixing device is configured to fix the toner image transferred on a recording medium and includes first and second belts rotatably disposed opposite to each other such that the recording medium having the toner image thereon moves therebetween, a fixing roller disposed in contact with an inner surface of the first belt, a pressure roller disposed in contact with an inner surface of the second belt and facing the fixing roller via the first and second belts, a first supporting member disposed downstream of the fixing roller and held in contact with the inner surface of the first belt, and a second supporting member disposed downstream of the pressure roller, held in contact with the inner surface of the second belt and facing the first supporting member via the first and second belts. The fixing roller and the pressure roller form a first nip part. A second nip part is formed downstream of the first nip portion and upstream of a portion between the first and second supporting members facing each other via the first and second belts.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
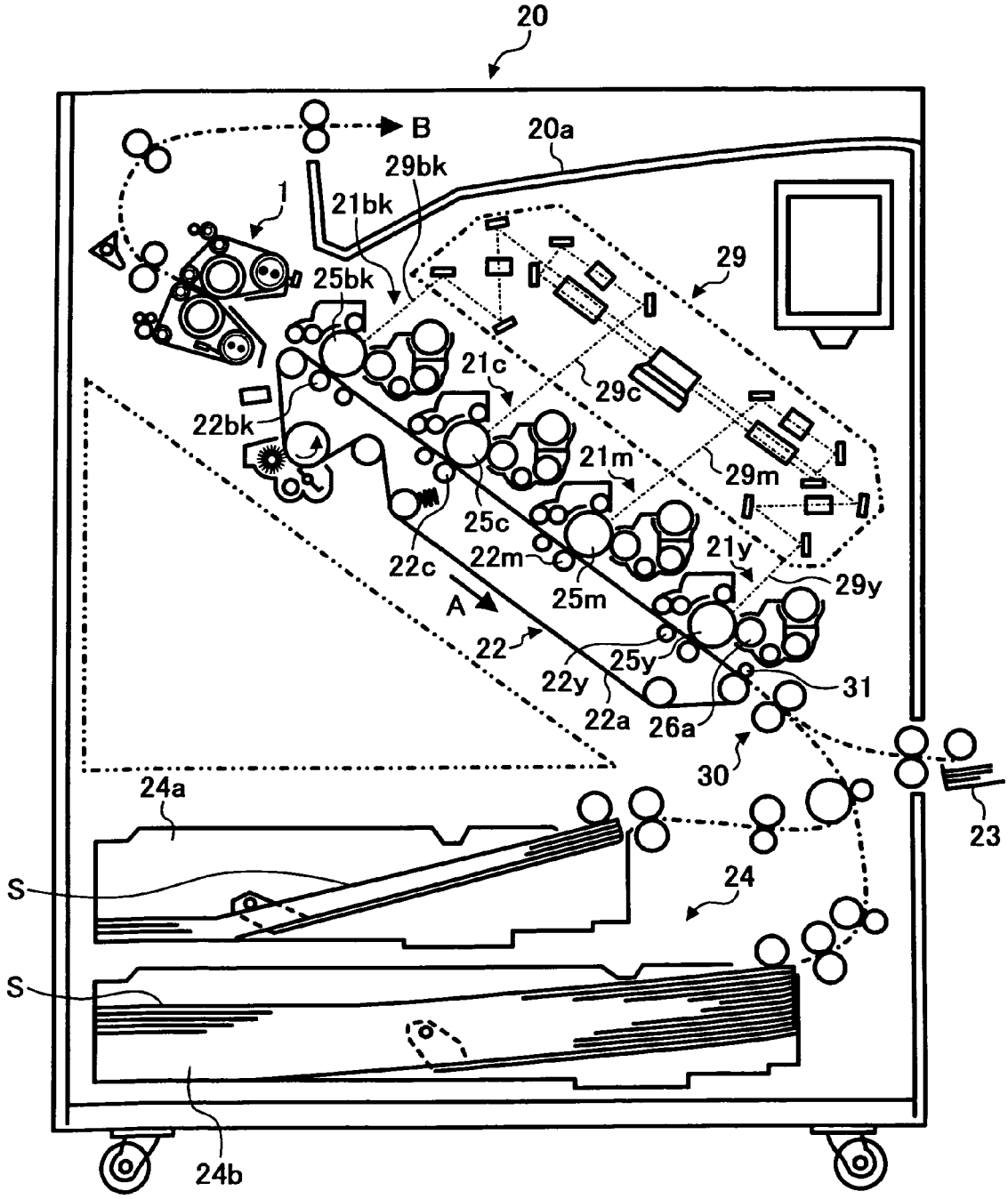
FIG. 1 is a schematic structure of an image forming apparatus including a fixing device according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Referring to FIG. 1, a schematic structure of an image forming apparatus 20 including a fixing device 1 according to an exemplary embodiment of the present invention is described.

Although the embodiments of the present invention discuss the image forming apparatus 20 serving as a color laser printer in which images are optically written by laser light beams corresponding to image data of different colors, an image forming apparatus such as a copier, printer, facsimile machine and the like may be applied to the present invention.

The image forming apparatus 20 of FIG. 1 uses a direct transfer method in which respective color images formed on respective image bearing members are directly transferred onto a recording medium. More specifically, in the direct transfer method, respective color toner images formed on respective image bearing members are directly overlaid in order on a recording medium such as a recording sheet or a single piece of the recording sheet that is attracted to a transfer belt serving as a transfer member and is conveyed to respective image transferring areas.

In FIG. 1, the image forming apparatus 20 includes image forming units 21*m*, 21*c*, 21*y*, and 21*bk*, a transfer device 22, a manual sheet feeding tray 23, a sheet feeding device 24 including first and second sheet feeding cassettes 24*a* and 24*b*, a pair of registration rollers 30, and a fixing device 1.

The image forming units 21*m*, 21*c*, 21*y*, and 21*bk* form respective color image based on image signals corresponding to image data of an original document image received from an external device.

The transfer device 22 is disposed facing the image forming units 21*m*, 21*c*, 21*y*, and 21*bk*.

The transfer device 22 is a belt device serving as a belt transfer member.

The transfer device 22 includes a belt or transfer belt 22*a*, transfer bias applying units 22*m*, 22*c*, 22*y*, and 22*bk*, and an attracting bias applying unit 31. The belt or transfer belt 22*a* is spanned around a plurality of rollers.

The transfer bias applying units 22*m*, 22*c*, 22*y*, and 22*bk* are disposed facing respective photoconductive drums 25*m*,

25*c*, 25*y*, and 25*bk* which serve as image bearing members of the image forming units 21*m*, 21*c*, 21*y*, and 21*bk* so as to apply transfer bias to the respective photoconductive drums of the image forming units 21*m*, 21*c*, 21*y*, and 21*bk*.

The attracting bias applying unit 31 is disposed so as to contact the transfer belt 22*a*. The attracting bias applying unit 31 applied an attracting bias so as to attract a recording sheet prior to a transfer of a first color image in a moving direction of the transfer belt 22*a* indicated by arrow A in FIG. 1.

The manual sheet feeing tray 23 serving as a sheet feeding mechanism supplies recording media to the transfer areas in which the image forming units 21*m*, 21*c*, 21*y*, and 21*bk* and the transfer device 22 face.

The sheet feeding device 24 including the first and second sheet feeding cassettes 24*a* and 24*b* accommodate recording media according to respective sheet sizes.

The pair of registration rollers 30 supplies the recording sheet conveyed from one of the manual sheet feeding tray 23, the first sheet feeding cassette 24*a*, and the second sheet feeding cassette 24*b* in synchronization with respective image forming timings of the image forming units 21*m*, 21*c*, 21*y*, and 21*bk*.

The fixing device 1 performs a fixing process to a sheet-type recording medium having a toner image thereon after the image transfer area. The fixing device 1 employs a belt fixing method in which fixing belts are externally heated up to a predetermined temperature and face to each other so that a recording medium may be sandwiched. One of the fixing belts includes a fixing roller and the other includes a pressure roller. Each of the fixing belts is spanned around at least three rollers including a heat source. The fixing roller and the pressure roller face to each other via the respective fixing belts, sandwiching and conveying the recording sheet, to form a fixing nip portion. The at least three rollers support each of the fixing belts. Details of the structure and function of the fixing device 1 will be described later.

In performing the image forming operations, the image forming apparatus 100 may print an image on a recording medium, for example, a plain paper; a 90K sheet such as a sheet for an overhead projector (or an OHP sheet), a card, and a postcard; a heavy paper having a basis weight of approximately 100 g/m$^2$ or more; and a special sheet having a greater heat capacity such as an envelope, etc.

A full-color image forming operation of the image forming apparatus 20 is now described.

When the image forming apparatus 20 receives full color image data, an optical writing device 29 irradiates the respective photoconductive drums 25*m*, 25*c*, 25*y*, and 25*bk* included in the image forming units 21*ym*, 21*c*, 21*y*, and 21*bk* with respective laser light beams 29*m*, 29*c*, 29*y*, and 29*bk* emitted by the optical writing device 29 corresponding to the respective color image data. The image forming units 21*ym*, 21*c*, 21*y*, and 21*bk* form respective electrostatic latent images, which correspond to the respective color image data, on respective surfaces of the photoconductive drums 25*m*, 25*c*, 25*y*, and 25*bk*. The image forming units 21*ym*, 21*c*, 21*y*, and 21*bk* then visualize the respective electrostatic latent images as toner images such as magenta, cyan, yellow and black toner images on the respective photoconductive drums 25*m*, 25*c*, 25*y*, and 25*bk*.

A recording sheet S serving as a recording medium (see FIGS. 2 and 3) is fed from one of the manual sheet feeding tray 23, and the first and second sheet feeding cassettes 24*a* and 24*b*. The image transfer area formed between the respective photoconductive drums 25*m*, 25*c*, 25*y*, and 25*bk* and the transfer belt 22*a* of the transfer device 22 pressed by the respective transfer bias applying units 22*m*, 22*c*, 22*y*, and 22*bk*. The recording sheet S is fed into the image transfer area in synchronization with the pair of registration rollers 30.

The recording sheet S is electrostatically attracted by the surface of the transfer belt 22*a*. The recording sheet S is fed while the recording sheet S is attracted by the transfer belt 22*a*.

The respective toner images formed on the respective surfaces of the photoconductive drums 25*m*, 25*c*, 25*y*, and 25*bk* are transferred onto a surface of the recording sheet S in an overlaying manner by electrostatic transfer provided by the respective transfer bias applying units 22*m*, 22*c*, 22*y*, and 22*bk* so that a full color toner image can be formed.

The recording sheet S is further conveyed by the transfer belt 22*a* to the fixing device 1.

The fixing device 1 fixes the full color toner image on the recording sheet S by the fixing device 1 through the application of heat and pressure. The recording sheet having the fixed full color image is discharged to a sheet discharging tray 20*a* in a direction indicated by arrow B after passing through a plurality of rollers.

Figure 2A:
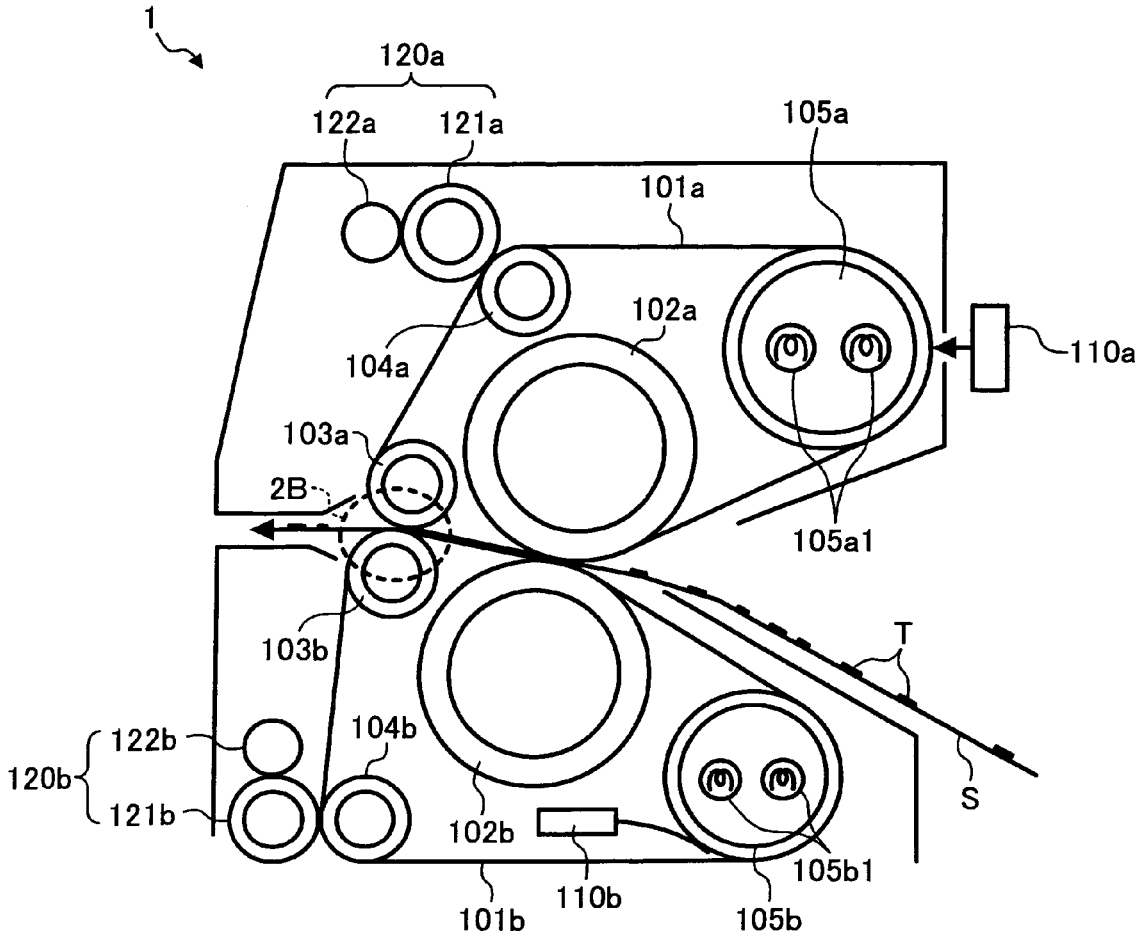
FIG. 2A is a structure of the fixing device of FIG. 1
Figure 2B:
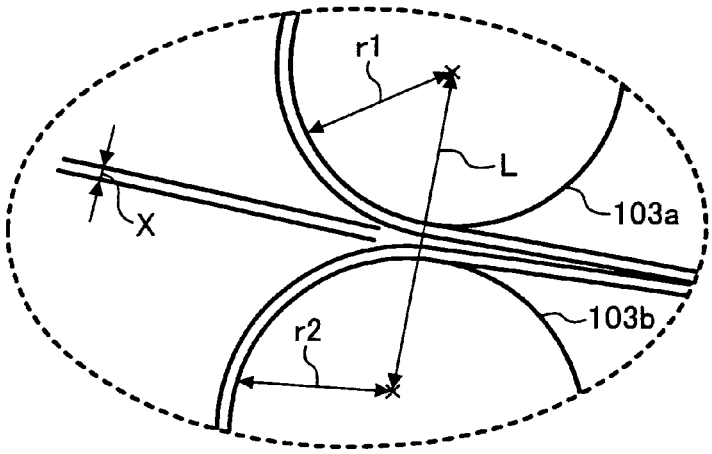
FIG. 2B is an enlarged portion around first and second supporting members of FIG. 2A.

Referring to FIGS. 2A and 2B, a schematic structure of the fixing device 1 of FIG. 1 is described.

The fixing device 1 includes first and second fixing belts 101*a* and 101*b*. In FIG. 2A, the first fixing belt 101*a* is disposed to face one surface side of a recording sheet S, and the second fixing belt 101*b* is disposed to face the other surface side of the recording sheet S.

The first fixing belt 102*a* includes a plurality of rollers including a fixing roller 102*a*, a first supporting member 103*a*, a tension member 104*a*, and a heat roller 105*a*, and a temperature detector 110*a*.

The second fixing belt 101*b* includes a plurality of rollers including a pressure roller 102*b*, a second supporting member 103*b*, a tension member 104*b*, and a heat roller 105*b*, and a temperature detector 110*b*.

Since the first and second fixing belts 101*a* and 101*b* have similar structure and function, except dispositions and functions of some components, the discussion below with respect to FIG. 2 may be mainly made for the first fixing belt 101*a* while the second fixing belt 101*b* of FIG. 2A may be described when necessary. In other words, the discussion below which describes the first fixing belt 101*a*, simultaneously describes the second fixing belt 101*b*.

The first fixing belt 101*a* includes a base layer, a middle layer, and an outer layer. The base or substrate layer is in the form of an endless belt having a diameter of approximately 70 mm. The base layer of the first fixing belt 101*a* can be fabricated of a polyimide resin material having a thickness of approximately 90 μm and is overcoated with the middle layer. The middle layer is an elastic layer of, for example, silicone rubber having a thickness of approximately 200 μm. The outer layer is fabricated of a fluorocarbon resin material including a perfluoroalkoxy (PFA) having a thickness of approximately 30 μm and is provided on the middle layer.

The first fixing belt 101*a* is spanned around at least three rollers. More specifically, the first fixing belt 101*a* is supported for movement in an endless path by a plurality of rollers including the fixing roller 102*a*, the first supporting member 103*a*, the tension member 104*a*, and the heat roller 105*a*. The fixing roller 102*a*, the first supporting member 103*a*, the tension member 104*a*, and the heat roller 105*a* support the first fixing belt 101*a* such that the first fixing belt 101*a* may have a tensioned surface and travel in a direction indicated by arrow C of FIG. 2, which is the same direction as a moving direction of the recording sheet S.

Each of the fixing roller 102*a* and the pressure roller 102*b* includes a core and a layer formed around a surface of the core. The layer is fabricated from an elastic material with adiathermancy. The fixing roller 102*a* and the pressure roller 102*b* are disposed to face each other with the first and second fixing belts 101*a* and 101*b* therebetween.

The first and second supporting members 103*a* and 103*b* are disposed downstream of the fixing roller 102*a* and the pressure roller 102*b*, respectively, and are not held in contact with each other. That is, there is a gap between the first and second supporting members 103*a* and 103*b*. The first supporting member 103*a* has a diameter smaller than the diameter of the fixing roller 102*a*, and the second supporting member 103*b* has a diameter smaller than the diameter of the pressure roller 102*b*. The first and second supporting members 103*a* and 103*b* may be a roller, a coil, or a member having other-shape.

The fixing roller 102*a* and the pressure roller 102*b* of the present invention have substantially the same structure. Both the fixing roller 102*a* and the pressure roller 102*b* include heaterless rollers and are made of a metallic core and a layer made of an adiathermic elastic material such as a foamed silicone having a thickness of approximately 6 mm. With this structure, a fixing nip portion formed between the fixing roller 102*a* and the pressure roller 102*b* may apply a substantially same amount of pressure to front and rear surface sides of the recording sheet S, which results in the same degree of deformation of the recording sheet S sandwiched by the fixing roller 102*a* and the pressure roller 102*b*. In other words, the recording sheet S can be conveyed without deformation being caused by pressure applied by the fixing roller 102*a* and the pressure roller 102*b*.

The tension member 104*a* and the heat roller 105*a* provide suitable tensioning of the first fixing belt 101*a*, and the tension member 104*b* and the heat roller 105*b* provide suitable tensioning of the second fixing belt 101*b*.

The tension member 104*a* may be a roller or a member having other shape. The tension member 104*a* is disposed downstream of the fixing roller and is held in contact with the inner surface of the first fixing belt 101*a*.

The heat roller 105*a* includes a halogen heater 105*a*1 as a heat source. The halogen heater 105*a*1 is internally disposed at the heat roller 105*a* to heat the first fixing belt 101*a* disposed downstream thereof. That is, the halogen heater 105*a*1 serving as a heat source is disposed upstream of the fixing nip portion formed between the fixing roller 102*a* and the pressure roller 102*b*. The halogen heater 105*a*1 is controlled by a signal according to a result detected by the temperature detector 110*a* of a non-contact type. The temperature detector 110*a* is a sensor such as an infrared radiation sensor disposed in the vicinity of the heat roller 105*a*. The temperature detector 110*a* may detect a surface temperature or a temperature on a surface of the first fixing belt 101*a*.

The heat roller 105*b* contacting the second fixing roller 101*b* also includes a halogen heater 105*b*1 serving as a heat source internally disposed at the heat roller 105*b* to heat the second fixing belt 101*b*. The halogen heater 105*b*1 is also disposed upstream of the fixing nip portion formed between the fixing roller 102*a* and the pressure roller 102*b*. The halogen heater 105*b*1, however, is controlled by the temperature detector 110*b* of a contact type. That is, the temperature detector 110*b* such as a thermistor detects the surface temperature of the heat roller 105*b* by directly contacting a surface of the heat roller 105*b*.

Although the temperature detector 110*b* is held in contact with the heat roller 105*b*, the temperature detector 110*b* does not contact the second fixing belt 101*b*. Since the temperature detector 110*a* does not originally contact the first fixing belt 101*a*, the temperature detector 110*a* does not contact the second fixing belt 101*b*. Therefore, the above-described structures can avoid damage to the respective surfaces of the first and second fixing belts 101*a* and 101*b* caused when the temperature detectors 110*a* and 110*b* contact, rub or scrape the respective surfaces thereof.

Even though the present embodiment discusses a halogen heater internally disposed at a heat roller, the present invention is not limited to a heat roller using a halogen heater disposed therein. For example, a heat roller using an induction heating system can be applied to the present invention. Further, the heat roller can have the halogen heater or the induction heating system disposed externally thereof.

As previously described, the tension members 104*a* and 104*b* have the adiathermic rollers same as the fixing roller 102*a* and the pressure roller 102*b*. The tension member 104*a* is disposed in contact with an inner surface of the first fixing belt 101*a* to face a cleaning unit 120*a*, sandwiching the first fixing belt 101*a*, and the tension member 104*b* is disposed in contact with an inner surface of the second fixing belt 101*b* to face a cleaning unit 120*b*, sandwiching the second fixing belt 101*b*.

The cleaning unit 120*a* includes a cleaning roller 121*a* which is disposed in contact with the first fixing belt 101*a*, and a retaining roller 122*a* which is disposed in contact with the cleaning roller 121*a*.

The cleaning unit 120*b* also includes a cleaning roller 121*b* disposed in contact with the second fixing belt 101*b*, and a retaining roller 122*b* which is disposed in contact with the cleaning roller 121*b*, both having the same structure and function as the cleaning roller 121*a* and the retaining roller 122*a* of the cleaning unit 120*a*.

The cleaning units 120*a* and 120*b* are disposed to face the tension members 104*a* and 104*b*, respectively, which are disposed downstream of the fixing roller 102*a* and the pressure roller 102*b* and are held in contact with the respective inner surfaces of the first and second fixing belts 101*a* and 101*b*, respectively. The structures allow the tension members 104*a* and 104*b* to perform as respective backing members of the first and second fixing belts 101*a* and 101*b*, so that the cleaning rollers 121*a* and 121*b* of the respective cleaning units 120*a* and 120*b* may press contact with the first and second fixing belts 101*a* and 101*b* at stable pressure. Consequently, residual foreign materials such as toner and paper dust may effectively be removed from the respective surfaces of the first and second fixing belts 101*a* and 101*b*.

As previously described, the fixing roller 102*a* and the pressure roller 102*b* may form the fixing nip portion therebetween so as to fix an unfixed toner image onto the recording sheet S. This embodiment shows another fixing nip portion formed between tensioned surfaces generated between respective rollers in the travel direction of the recording sheet S. That is, another fixing nip portion is formed downstream of the fixing nip portion formed between the fixing roller 102*a* and the pressure roller 102*b* and upstream of a portion between the first and second supporting members 103*a* and 103*b* facing each other via the first and second fixing belts 101*a* and 101*b*. (Hereinafter, the fixing nip portion formed between the fixing roller 102*a* and the pressure roller 102*b* is referred to as a "first fixing nip portion", and the fixing nip portion formed downstream of the first fixing nip portion is referred to as a "second fixing nip portion.") The second fixing nip portion may sandwich the recording sheet S traveling in the direction C shown in FIG. 2 to further fix the toner image after the recording sheet S passes through the first fixing nip portion between the fixing roller 102*a* and the pressure roller 102*b*. Accordingly, the second fixing nip portion may provide a larger and longer fixing nip portion. The second fixing nip portion is defined as an operable fixing nip portion having a smaller amount or amounts of heat and/or pressure applied thereto, compared to the first fixing nip portion.

To form the second fixing nip portion as shown in FIG. 2B, a gap formed between the first and second supporting members 103*a* and 103*b* may be established as described below.

The gap formed between the first and second supporting members 103*a* and 103*b* in disposition as shown in FIG. 2B are determined by the following relationship:

$$0\ (\text{mm}) < L-(r1+r2+t1+t2) < 5\ (\text{mm})$$

where "L" represents a center distance between the first and second supporting members 103*a* and 103*b*, "r1" represents a radius of the first supporting member 103*a*, "r2" represents a radius of the second supporting member 103*b*, "t1" represents a thickness of the first fixing belt 101*a*, and "t2" represents a thickness of the second fixing belt 101*b*.

A reference character "X" shown in FIG. 2B is a distance of the gap between the first and second supporting members 103*a* and 103*b*, determined according to the above-described relationship. The above-described relationship may prevent an irregularity of an image caused by fluctuations of a plurality of fixing nip portions. More specifically, an irregular image produced due to differences of transfer speed or velocity and/or surface pressure among a plurality of fixing nip portions may be prevented. The above-described relationship may also prevent glossiness in a solid image from changing, for example, because of instability of a stripping portion of the recording sheet S.

More specifically, when a gap X in FIG. 2B is 0 mm, the first and second fixing belts 101*a* and 101*b* may be held in contact with each other to produce a plurality of fixing nip portions. This may cause differences in travel speed or velocity and/or surface pressure among the plurality of fixing nip portions, which may result in an irregular image. In this embodiment, the second fixing nip portion is formed such that toner on the recording sheet S may be heated by applying a smaller amount of heat and pressure at a portion downstream of the first fixing nip portion formed between the fixing roller 102*a* and the pressure roller 102*b*.

By forming the second fixing nip portion, a heated area between the first and second fixing belts 101*a* and 101*b* may increase to provide an amount of heat necessary for fixing the toner image onto the recording sheet S even when a temperature necessary for heating the first and second fixing belts 101*a* and 101*b* to fix the toner image at the first fixing nip portion is set to a lower point, thereby shortening the period of a rise time of the temperature necessary for heating the first and second fixing belts 101*a* and 101*b* to the predetermined temperature.

When the gap X is greater than 5 mm, the recording sheet S in which the toner image is fixed thereto at the first fixing nip portion formed between the fixing roller 102*a* and the pressure roller 102*b* cannot stably be stripped from the first and second fixing belts 101*a* and 101*b*, which cannot ensure an amount of heat necessary for fixing the toner image. This may cause differences in glossiness in a solid image. Therefore, the gap X in this embodiment is determined to be equal to or smaller than 5 mm to prevent the change in a stripping condition of the recording sheet S at the first fixing nip portion so that the above-described problems may be avoided. The recording sheet S may easily be stripped from the first and second fixing belts 101*a* and 101*b* by using the curvature of the first and second supporting members 103*a* and 103*b* having a diameter smaller than the fixing roller 102*a* and the pressure roller 102*b*. This regulates the stripping position of the recording sheet S to a mere portion between the first and second supporting members 103 and 103*b* so that the stripping operation may be performed in a stable condition after the recording sheet S passes through the first fixing nip portion between the fixing roller 102*a* and the pressure roller 102*b*. Since the first and second supporting member 103*a* and 103*b* have a diameter smaller than the fixing roller 102*a* and the pressure roller 102*b*, the recording sheet S can surely perform self stripping. Thus, the use of a member for stripping the recording sheet S, such as stripping fingers, may not be required. When the stripping fingers are not used, damage generated when the stripping fingers are used by contacting, rubbing, or scraping the toner on the recording sheet S may be eliminated, thereby preventing a defective image because of the irregularity of the image.

With the structure as described in this embodiment, the recording sheet S having the toner image thereon may be surely fixed by the fixing device 1.

That is, the fixing device 1 is provided with a fixing belt having a smaller amount of heat capacity as well as a first fixing nip portion between the fixing roller 102*a* and the pressure roller 102*b* and the second fixing nip portion between the first and second supporting member 103*a* and 103*bm* disposed downstream of the first fixing nip portion to provide a larger and longer fixing nip portion. Therefore, an adequate amount of heat necessary for fixing may be ensured even when the first and second fixing belts 101*a* and 101*b* set the predetermined temperature to a lower point than that of the first fixing nip portion. The lower temperature may reduce an amount of power consumed and shorten the period of the rise time of the predetermined temperature.

The first and second supporting member 103*a* and 103*b* forming the second fixing nip portion downstream of the first fixing nip portion formed between the fixing roller 102*a* and the pressure roller 102*b* have the similar structure applying the substantially same amount of pressure to the recording sheet S passing through the second fixing nip portion. When one of a pair or rollers applies a greater amount of pressure to a recording sheet than the other, the recording sheet may be deformed and become wrinkled after passing through the fixing nip portion. Since the second fixing nip portion described in the embodiment can provide a substantially same amount of pressure to the recording sheet S, the recording sheet S may not be deformed and can remain its planarity. Thus, the above-described structure may convey a recording sheet such as a single piece of sheet material and a two-ply envelope with planarity such that the recording sheet S may be prevented from wrinkles thereon due to instability of conveyance.

Further, the fixing roller 102*a*, the pressure roller 102*b*, the first and second supporting members 103*a* and 103*b*, the tension members 104*a* and 104*b*, which are the rollers except for the heat rollers 105*a* and 105*b*, have an adiathermic or insulative structure which can prevent unnecessary heat radiation, thereby preventing the temperature of the first and second fixing belts 101*a* and 101*b* from dropping and shortening the period of the rise time to the predetermined temperature.

Figure 3A:
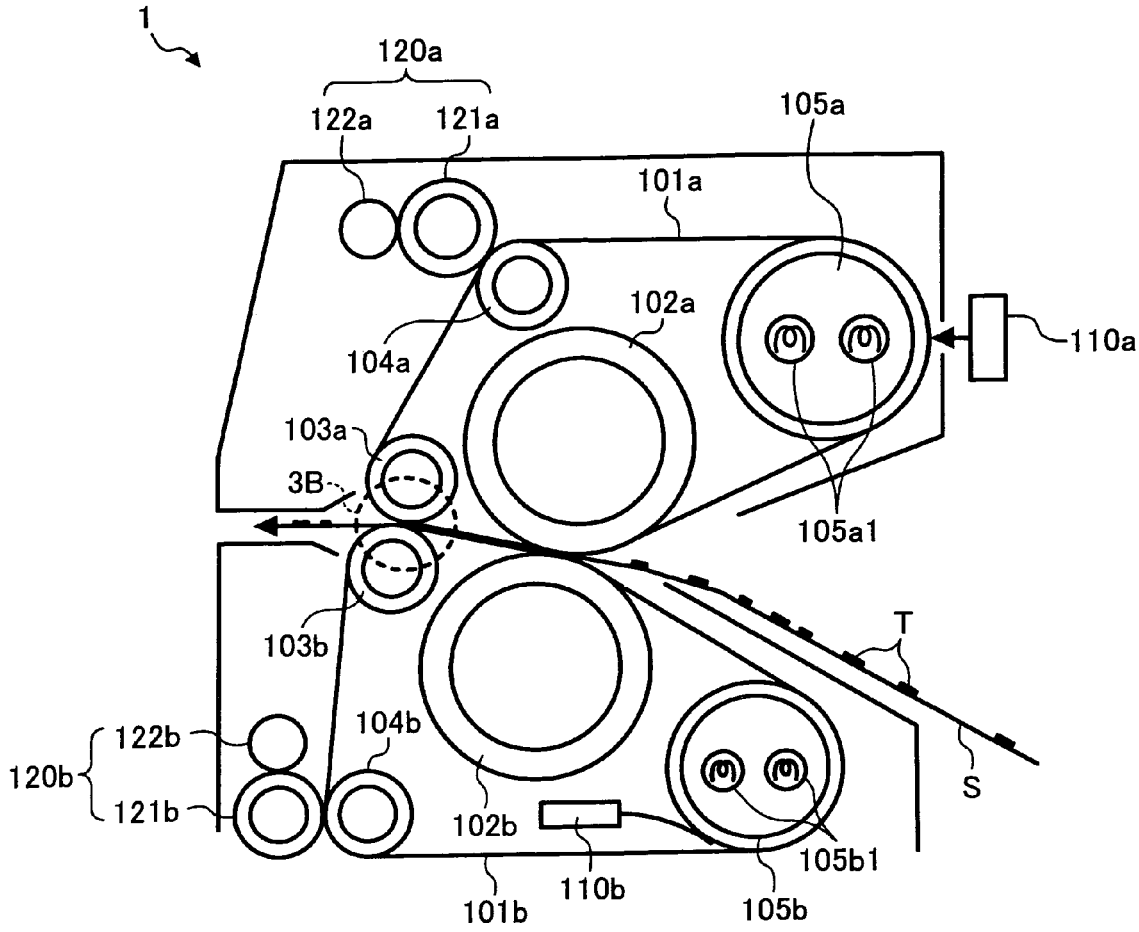
FIG. 3A is another structure of the fixing device alternative to FIG. 2A
Figure 3B:
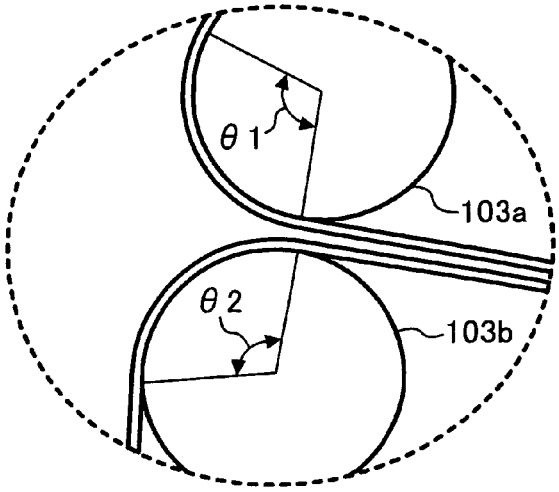
FIG. 3B is an enlarged portion around the first and second supporting members of FIG. 3A.

Referring to FIGS. 3A and 3B, another structure of the fixing device 1 alternative to the structure shown in FIGS. 2A and 2B is described.

In FIG. 3A, the first and second fixing belts 101*a* and 101*b* have respective contact angles equal to or smaller than 120 degrees with respect to the rollers except for the heat rollers 105*a* and 105*b*. When the contact angle is set to equal to or smaller than 120 degrees, the first and second fixing belts 101*a* and 101*b* around the second fixing nip portion are extended or tightened so as to make it easier to load a tension. In this embodiment, the first and second supporting members 103*a* and 103*b* may have the greatest contact angle among the rollers except for the heat rollers 105*a* and 105*b* as shown in FIG. 3A. This is because the first and second supporting members 103*a* and 103*b* are disposed at respective positions in which the first and second fixing belts 101*a* and 101*b* are detoured. Thereby, in this embodiment, a contact angle of the first supporting member 103*a*, represented by "θ1 ", is determined to be approximately 105 degrees, and a contact angle of the second supporting member 103*b*, represented by "θ2", is determined to be approximately 98 degrees.

When the respective contact angles of the rollers except for the heat rollers 105*a* and 105*b* are regulated to be equal to or smaller than 120 degrees, with respect to the corresponding one of the first and second fixing belts 101*a* and 101*b*, the first and second fixing belts 101*a* and 101*b* around the second fixing nip portion are tensioned, as described above, and a contact area between the first and second fixing belts 101*a* and 101*b* and the respective peripheries of the rollers except the heat rollers 105*a* and 105*b* may be reduced. The smaller the contact area is, the less amount of heat may be dissipated. That is, the small contact angle may generate the small contact area, which may reduce a heat dissipation area with respect to the contact area. Thereby, the period of rise time to the predetermined temperature may be reduced, resulting in improving a thermal response.

According to the above-described embodiments, the fixing device 1 of the image forming apparatus 20 can improve the thermal response to the predetermined temperature of the first and second fixing belts 101*a* and 101*b* and reduce the damage by rubbing and/or scratching the toner image on the recording sheet S, thereby improving period of rise time to the predetermined temperature and preventing a production of defective images.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

What is claimed as new and desired to be secured by Letters Patent of the United States is:

1. A fixing device for fixing a toner image on a recording medium, comprising:

first and second belts rotatably disposed opposite to each other such that the recording medium having the toner image thereon moves therebetween;

a fixing roller disposed in contact with an inner surface of the first belt;

a pressure roller disposed in contact with an inner surface of the second belt and facing the fixing roller via the first and second belts, the fixing roller and the pressure roller forming a first nip part;

a first supporting member disposed downstream of the fixing roller and held in contact with the inner surface of the first belt; and a second supporting member disposed downstream of the pressure roller, held in contact with the inner surface of the second belt and facing the first supporting member via the first and second belts, wherein a second nip part is formed downstream of the first nip portion and upstream of a portion between the first and second supporting members facing each other via the first and second belts and wherein the portion between the first and second supporting members facing each other via the first and second belts includes a gap.

2. The fixing device according to claim 1, which comprises a heat source disposed upstream of the first nip part.

3. The fixing device according to claim 2, wherein the fixing roller and the pressure roller include heaterless rollers.

4. The fixing device according to claim 1, wherein the first supporting member has a smaller diameter than the fixing roller and the second supporting member has a smaller diameter than the pressure roller.

5. The fixing device according to claim 1, wherein the gap is determined by the following relationship:

$$0\ (\text{mm}) < L-(r1+r2+t1+t2) < 5\ (\text{mm})$$

where "L" represents a center distance between the first and second supporting members, "r1" represents a radius of the first supporting member, "r2" represents a radius of the second supporting member, "t1" represents a thickness of the first belt, and "t2" represents a thickness of the second belt.

6. The fixing device according to claim 1, further comprising:

a tension member disposed downstream of the fixing roller and contacting the inner surface of the first belt; and a cleaning member disposed opposite to the tension member via the first belt.

7. The fixing device according to claim 6, wherein the cleaning member comprises:

a primary cleaning roller disposed in contact with the first belt; and a secondary cleaning roller rotatably disposed in contact with the primary cleaning roller.

8. The fixing device according to claim 1, further comprising:

a tension member disposed downstream of the pressure roller and contacting the inner surface of the second belt; and a cleaning member disposed opposite the tension member via the second belt.

9. The fixing device according to claim 8, wherein the cleaning member comprises:

a primary cleaning roller disposed in contact with the second belt; and a secondary cleaning roller rotatably disposed in contact with the primary cleaning roller.

10. A fixing device for fixing a toner image on a recording medium, comprising:

first and second belts rotatably disposed opposite to each other such that the recording medium having the toner image thereon moves therebetween;

a fixing roller disposed in contact with an inner surface of the first belt;

a pressure roller disposed in contact with an inner surface of the second belt and facing the fixing roller via the first and second belts, the fixing roller and the pressure roller forming a first nip part;

a first supporting member disposed downstream of the fixing roller and held in contact with the inner surface of the first belt; and a second supporting member disposed downstream of the pressure roller, held in contact with the inner surface of the second belt and facing the first supporting member via the first and second belts, wherein a second nip part is formed downstream of the first nip portion and upstream of a portion between the first and second supporting members facing each other via the first and second belts, and wherein the fixing roller and the first supporting member include respective contact angles with said first belt which are smaller than or equal to 120 degrees.

11. The fixing device according to claim 10, wherein the pressure roller and the second supporting member include respective contact angles with said second belt which are smaller than or equal to 120 degrees.

12. An image forming apparatus, comprising:

an image forming unit configured to form a toner image;

an image transferring unit configured to transfer the toner image from the image forming unit to a recording medium; and a fixing device configured to fix the toner image transferred on a recording medium, comprising:

first and second belts rotatably disposed opposite to each other such that the recording medium having the toner image thereon moves therebetween;

a fixing roller disposed in contact with an inner surface of the first belt;

a pressure roller disposed in contact with an inner surface of the second belt and facing the fixing roller via the first and second belts, the fixing roller and the pressure roller forming a first nip part;

a first supporting member disposed downstream of the fixing roller and held in contact with the inner surface of the first belt; and a second supporting member disposed downstream of the pressure roller, held in contact with the inner surface of the second belt and facing the first supporting member via the first and second belts, wherein a second nip part is formed downstream of the first nip portion and upstream of a portion between the first and second supporting members facing each other via the first and second belts and wherein the portion between the first and second supporting members facing each other via the first and second belts includes a gap.

13. The image forming apparatus according to claim 12, wherein a heat source is disposed upstream of the first nip part.

14. The image forming apparatus according to claim 13, wherein the fixing roller and the pressure roller include heaterless rollers.

15. The image forming apparatus according to claim 12, wherein the first supporting member has a smaller diameter than the fixing roller and the second supporting member has a smaller diameter than the pressure roller.

16. The image forming apparatus according to claim 12, wherein the gap is determined by the following relationship:

$$0\ (\text{mm}) < L-(r1+r2+t1+t2) < 5\ (\text{mm})$$

where "L" represents a center distance between the first and second supporting members, "r1" represents a radius of the first supporting member, "r2" represents a radius of the second supporting member, "t1" represents a thickness of the first belt, and "t2" represents a thickness of the second belt.

17. The image forming apparatus according to claim 12, further comprising:

a tension member disposed downstream of the fixing roller and contacting the inner surface of the first belt; and a cleaning member disposed opposite to the tension member via the first belt.

18. The image forming apparatus according to claim 17, wherein the cleaning member comprises:

a primary cleaning roller disposed in contact with the first belt; and a secondary cleaning roller rotatably disposed in contact with the primary cleaning roller.

19. The image forming apparatus according to claim 12, further comprising:

a tension member disposed downstream of the pressure roller and contacting the inner surface of the second belt; and a cleaning member disposed opposite to the tension member via the second belt.

20. The image forming apparatus according to claim 19, wherein the cleaning member comprises:

a primary cleaning roller disposed in contact with the second belt; and a secondary cleaning roller rotatably disposed in contact with the primary cleaning roller.

21. The image forming apparatus according to claim 13, further comprising a temperature detector disposed at one of a position outside of one of the first and second belts in a non-contact manner and a position inside of one of the first and second belts in contact with the heat source.

22. An image forming apparatus, comprising:

an image forming unit configured to form a toner image;

an image transferring unit configured to transfer the toner image from the image forming unit to a recording medium; and a fixing device configured to fix the toner image transferred on a recording medium, comprising:

first and second belts rotatably disposed opposite to each other such that the recording medium having the toner image thereon moves therebetween;

a fixing roller disposed in contact with an inner surface of the first belt;

a pressure roller disposed in contact with an inner surface of the second belt and facing the fixing roller via the first and second belts, the fixing roller and the pressure roller forming a first nip part;

a first supporting member disposed downstream of the fixing roller and held in contact with the inner surface of the first belt; and a second supporting member disposed downstream of the pressure roller, held in contact with the inner surface of the second belt and facing the first supporting member via the first and second belts, wherein a second nip part is formed downstream of the first nip portion and upstream of a portion between the first and second supporting members facing each other via the first and second belts, and wherein the fixing roller and the first supporting member include respective contact angles with said first belt which are smaller than or equal to 120 degrees.

23. The image forming apparatus according to claim 22, wherein the pressure roller and the second supporting member include respective contact angles with said second belt which are smaller than or equal to 120 degrees.

* * * * *